US009187918B2

(12) United States Patent
Ermer et al.

(10) Patent No.: US 9,187,918 B2
(45) Date of Patent: Nov. 17, 2015

(54) HIGH RISE BUILDING WITH A STAIRWELL AND A INTAKE AIR SHAFT

(75) Inventors: Horst A. Ermer, Biberist (CH); Hans Gaida, Korschenbroich (DE)

(73) Assignee: SWISS RALTEC GMBH, Biberist (CH)

( * ) Notice: Subject to any disclaimer, the term of this patent is extended or adjusted under 35 U.S.C. 154(b) by 899 days.

(21) Appl. No.: 13/083,374

(22) Filed: Apr. 8, 2011

(65) Prior Publication Data

US 2011/0179732 A1 Jul. 28, 2011

Related U.S. Application Data

(63) Continuation of application No. PCT/EP2009/063129, filed on Oct. 8, 2009.

(30) Foreign Application Priority Data

Oct. 8, 2008 (DE) ..... 10 2008 050 438

(51) Int. Cl.
*E04H 14/00* (2006.01)
*E04H 1/04* (2006.01)
(Continued)

(52) U.S. Cl.
CPC *E04H 1/04* (2013.01); *B08B 15/00* (2013.01); *F24F 11/0001* (2013.01); *F24F 2011/0004* (2013.01); *F24F 2011/0095* (2013.01); *F24F 2221/50* (2013.01)

(58) Field of Classification Search
CPC ... F24F 11/00; F24F 11/0001; F24F 11/0079; F24F 7/00; F24F 7/02; F24F 2011/0004; F24F 2011/0095; F24F 2221/50; A62C 2/24; F23J 11/12; E04F 11/02; E04H 1/04; B08B 15/00
USPC ..... 454/49, 188, 189, 195, 238, 249, 454/254–257, 322, 333, 338, 340, 341, 342, 454/345, 357, 369; 52/30, 185, 236.3, 52/236.4, 236.7; 169/60, 61, 48, 49, 50, 169/64; 236/49.2
See application file for complete search history.

(56) References Cited

U.S. PATENT DOCUMENTS 4,044,947 A * 8/1977 Spethmann ..... 236/13
5,638,639 A * 6/1997 Goodman et al. ..... 49/7
(Continued)

FOREIGN PATENT DOCUMENTS

CA 2426391 A1 * 10/2004 ..... E04F 17/04
DE 2323178 11/1974
(Continued)

OTHER PUBLICATIONS

Lovatt, John E., Wilson, A. Grant, "Stack Effect in Tall Buildings". ASHRAE Transactions, vol. 100, Part 2, 1994.*
(Continued)

*Primary Examiner* — Gregory Huson
*Assistant Examiner* — Dana Tighe
(74) *Attorney, Agent, or Firm* — McCarter & English LLP

(57) ABSTRACT

A high-rise building has a stairwell, an air supply shaft, inlet openings connecting the air supply shaft to the stairwell, and a pressure system for keeping the stairwell free from smoke. The stairwell is vertically divided into several partial spaces. The separation is performed by at least one partition. Each partition has a door enabling a passage from one partial space of the stairwell into an adjacent partial space.

12 Claims, 3 Drawing Sheets

(51) Int. Cl.
*B08B 15/00* (2006.01)
*F24F 11/00* (2006.01)

(56) References Cited

U.S. PATENT DOCUMENTS

| | | | | |
|---|---|---|---|---|
| 6,000,505 | A * | 12/1999 | Allen | 187/391 |
| 2003/0074848 | A1 | 4/2003 | Palagonia et al. | |
| 2004/0173417 | A1 * | 9/2004 | Jokela et al. | 187/383 |

FOREIGN PATENT DOCUMENTS

| | | | | |
|---|---|---|---|---|
| DE | 19841540 | | 3/2000 | |
| DE | 19848736 | B4 * | 11/2004 | A62B 3/00 |
| DE | 202004016229 | | 1/2005 | |

OTHER PUBLICATIONS

Jo, Jae-Hun, Yeo, Myong-Souk, and Kim, Kwang-Woo, "Effect of Building Design on Pressure-related Problems in High-rise Residential Buildings". ARCC Spring Research Conference, Apr. 16-18, 2007.*

Budnick, E.K. and Klote, J.H., "The Capabilities of Smoke Control: Part II—System Performance and Stairwell Pressurization", Presented at NFPA Meeting, Nov. 1987, Portland, OR.*

International Search Report and Written Opinion of the International Searching Authority for International Application No. PCT/EP2009/063129 (8 pages).

* cited by examiner

HIGH RISE BUILDING WITH A STAIRWELL AND A INTAKE AIR SHAFT

CROSS-REFERENCE TO RELATED APPLICATIONS

This application is a continuation of International Patent Application No. PCT/EP2009/063129, filed Oct. 8, 2009 designating the United States, and claims priority under 35 U.S.C. §119(a)-(d) to German Application No. DE 10 2008 050 438.6, filed Oct. 8, 2008, the contents of both of which are hereby incorporated by reference in their entirety as part of the present disclosure.

FIELD OF THE INVENTION

The invention relates to a high-rise building with a stairwell, an air supply shaft, inlet openings connecting the air supply shaft to the stairwell, and a pressure system for keeping the stairwell free from smoke, the stairwell is vertically divided into at least two partial spaces by at least one partition, and each partition comprises a door which enables a passage from one partial space of the stairwell into the adjacent partial space.

BACKGROUND INFORMATION

In high-rise buildings of up to about 197 ft, i.e., approx. 60 m, that is, with about 15-20 floors, the stairwell can reliably be kept free from smoke by a relatively homogeneous overpressure if, for example, supply air is blown in at the lowermost area of the stairwell and, simultaneously, via the air supply shaft through the inlet openings into the stairwell. This technique is the prior art on which the invention is based.

When buildings become higher, it becomes substantially more difficult, however, to establish a relatively homogeneous pressure column over the entire height of the stairwell. The reason for this lies in the geometry of the stairwell. The windings of the stairs and the banisters, but also large parts of the stairwell, form flow resistances. This leads to an average of 0.04 lb/ft$^2$, which is 2 Pa (Pascal) pressure being lost per floor.

According to the European Standard EN 12101, Part 6, Issue September 2005, the following is prescribed for smoke-free evacuation paths in buildings:

Door opening force maximally 100 N (which is 22.5 lbf),

Overpressure in the stairwell with closed doors relative to the floors 50 Pa±10% (which is 1.04 lb/ft$^2$), and mean airspeed in the opened entrance door between the stairwell and the utilization unit≥2 m/s (≥6.56 ft/s) in the case of a fire-fighting operation by the fire department.

As the admissible pressure range is thus between 0.94 and 1.15 lb/ft$^2$, i.e., 45 and 55 Pa, only five of the 15-20 floors are pressurized correctly in the above example. All floors above that have a pressure lower than 0.94 lb/ft$^2$, i.e., lower than 45 Pa.

According to the prior art, this problem can be addressed by providing the inlet openings already mentioned from about the ninth floor; they are provided, for example, at every third floor. Through them, air is let into the stairwell from the air supply shaft, which is usually adjacent to the stairwell. A stable homogeneity of the pressure can thus be obtained over the entire height of the building.

However, this only applies to buildings up to a certain height. Given the efforts for increasingly higher high-rise buildings, for example beyond 393 ft, i.e., 120 m, physical effects such as the stack effect cannot remain left aside. In particular, the stack effect caused by the temperature difference between the internal and the external temperature (for example in the summer and in the winter) has negative effects on the forces for opening a door, and does so already during normal operation of the building, not just in extreme cases.

The following table shows a sample calculation for a high-rise building with 42 floors; the table shows how the pressures between the stairwell and the utilization unit adjust in normal operation, during the summer and the winter. As a rule, in the case of pressures higher than 1.04 lb/ft$^2$, i.e., 50 Pa, it is difficult, if not impossible, for a person of normal weight and strength to open a door. The above-mentioned door opening force according to EN 12101-6, which is limited to a maximum of 22.5 lbf, i.e., 100 N, is exceeded.

In the table, the following notation is used for designating floors: floor 0 is the ground floor. Floor 1 is the first floor above the ground floor. Floor n in the n-th floor above floor 0. This system is different from the notation commonly used in the USA where floor 1 stands for the ground floor.

TABLE 1

Overpressures of the stairwells relative to the floors in an emergency and in normal ventilation operation while maintaining a minimum overpressure of 10 Pa and different temperature conditions

| | Height above sea | Temperatures the same on the inside and outside | | Temperatures higher on the inside than the outside | | Temperatures higher on the outside than the inside | |
|---|---|---|---|---|---|---|---|
| Floor | level m | $\Delta p_{emerg\text{-}op.}$ Pa | $\Delta p_{normal\text{-}op.}$ Pa | $\Delta p_{emerg\text{-}op.}$ Pa | $\Delta p_{normal\text{-}op.}$ Pa | $\Delta p_{emerg\text{-}op.}$ Pa | $\Delta p_{normal\text{-}op.}$ Pa |
| 0. (Ground) Floor | 0.00 | 94.8 | 10.7 | 10.0 | 10.0 | 149.9 | 65.8 |
| 1. Floor | 4.465 | 92.4 | 10.7 | 13.9 | 16.3 | 145.8 | 64.0 |
| 2. Floor | 8.93 | 89.9 | 10.6 | 17.8 | 22.7 | 141.6 | 62.3 |
| 3. Floor | 12.30 | 88.1 | 10.6 | 20.8 | 27.4 | 138.5 | 61.0 |
| 4. Floor | 15.67 | 86.3 | 10.6 | 23.7 | 32.2 | 135.3 | 59.7 |
| 5. Floor | 19.04 | 84.4 | 10.6 | 26.7 | 37.0 | 132.2 | 58.4 |
| 6. Floor | 22.41 | 82.6 | 10.6 | 29.6 | 41.8 | 129.1 | 57.1 |
| 7. Floor | 25.78 | 80.7 | 10.6 | 32.6 | 46.5 | 125.9 | 55.8 |
| 8. Floor | 29.15 | 78.9 | 10.5 | 35.5 | 51.3 | 122.8 | 54.5 |
| 9. Floor | 32.52 | 77.0 | 10.5 | 38.5 | 56.1 | 119.7 | 53.1 |
| 10. Floor | 35.89 | 75.2 | 10.5 | 41.4 | 60.9 | 116.5 | 51.8 |
| 11. Floor | 39.26 | 73.4 | 10.5 | 44.3 | 65.6 | 113.4 | 50.5 |

TABLE 1-continued

Overpressures of the stairwells relative to the floors in an emergency and in normal ventilation operation while maintaining a minimum overpressure of 10 Pa and different temperature conditions

| Floor | Height above sea level m | Temperatures the same on the inside and outside | | Temperatures higher on the inside than the outside | | Temperatures higher on the outside than the inside | |
|---|---|---|---|---|---|---|---|
| | | $\Delta p_{emerg\text{-}op.}$ Pa | $\Delta p_{normal\text{-}op.}$ Pa | $\Delta p_{emerg\text{-}op.}$ Pa | $\Delta p_{normal\text{-}op.}$ Pa | $\Delta p_{emerg\text{-}op.}$ Pa | $\Delta p_{normal\text{-}op.}$ Pa |
| 12. Floor | 42.63 | 71.5 | 10.5 | 47.3 | 70.4 | 110.3 | 49.2 |
| 13. Floor | 46.00 | 69.7 | 105 | 50.2 | 75.2 | 107.1 | 47.9 |
| 14. Floor | 49.37 | 67.8 | 10.5 | 53.2 | 80.0 | 104.0 | 46.6 |
| 15. Floor | 52.74 | 66.0 | 10.4 | 56.1 | 84.7 | 100.9 | 45.3 |
| 16. Floor | 56.11 | 64.1 | 10.4 | 59.1 | 89.5 | 97.7 | 44.0 |
| 17. Floor | 59.48 | 62.3 | 10.4 | 62.0 | 94.3 | 94.6 | 42.7 |
| 18. Floor | 62.85 | 60.5 | 10.4 | 65.0 | 99.1 | 91.4 | 41.4 |
| 19. Floor | 66.22 | 58.6 | 10.4 | 67.9 | 103.8 | 88.3 | 40.1 |
| 20. Floor | 69.59 | 56.8 | 10.4 | 70.9 | 108.6 | 85.2 | 38.8 |
| 21. Floor | 72.96 | 54.9 | 10.3 | 73.8 | 113.4 | 82.0 | 37.5 |
| 22. Floor | 76.33 | 53.1 | 10.3 | 76.8 | 118.2 | 78.9 | 36.1 |
| 23. Floor | 79.70 | 51.2 | 10.3 | 79.7 | 122.9 | 75.8 | 34.8 |
| 24. Floor | 83.07 | 49.4 | 10.3 | 82.7 | 127.7 | 72.6 | 33.5 |
| 25. Floor | 86.44 | 47.6 | 10.3 | 85.6 | 132.5 | 69.5 | 32.2 |
| 26. Floor | 89.81 | 45.7 | 10.3 | 88.6 | 137.3 | 66.4 | 30.9 |
| 27. Floor | 93.18 | 43.9 | 10.2 | 91.5 | 142.0 | 63.2 | 29.6 |
| 28. Floor | 96.55 | 42.0 | 10.2 | 94.5 | 146.8 | 60.1 | 28.3 |
| 29. Floor | 99.92 | 40.2 | 10.2 | 97.4 | 151.6 | 57.0 | 27.0 |
| 30. Floor | 103.29 | 38.3 | 10.2 | 100.4 | 156.4 | 53.8 | 25.7 |
| 31. Floor | 106.66 | 36.5 | 10.2 | 103.3 | 161.1 | 50.7 | 24.4 |
| 32. Floor | 110.03 | 34.7 | 10.2 | 106.3 | 165.9 | 47.6 | 23.1 |
| 33. Floor | 113.40 | 32.8 | 10.1 | 109.2 | 170.7 | 44.4 | 21.8 |
| 34. Floor | 116.77 | 31.0 | 10.1 | 112.2 | 175.5 | 41.3 | 20.5 |
| 35. Floor | 120.14 | 29.1 | 10.1 | 115.1 | 180.2 | 38.2 | 19.2 |
| 36. Floor | 123.51 | 27.3 | 10.1 | 118.1 | 185.0 | 35.0 | 17.8 |
| 37. Floor | 126.88 | 25.4 | 10.1 | 121.0 | 189.8 | 31.9 | 16.5 |
| 38. Floor | 130.25 | 23.6 | 10.1 | 124.0 | 194.6 | 28.8 | 15.2 |
| 39. Floor | 133.62 | 21.8 | 10.0 | 126.9 | 199.3 | 25.6 | 13.9 |
| 40. Floor | 136.99 | 19.9 | 10.0 | 129.9 | 204.1 | 22.5 | 12.6 |
| 41. Floor | 140.36 | 18.1 | 10.0 | 132.8 | 208.9 | 19.4 | 11.3 |
| 42. Floor | 143.73 | 16.2 | 10.0 | 135.8 | 213.7 | 16.2 | 10.0 |

1 Pa is approximately 0.021 lb/ft$^2$ and 1 m is approximately 3.28 ft.

SUMMARY OF THE INVENTION

This is where the invention comes in. It has set itself the object of achieving, also for relatively high high-rise buildings, for example also above 393 ft, i.e., 120 m total height, in any case above approx. 197 ft, i.e., 60 m, a homogeneous pressure maintenance in case of fire, and thus a limitation of the door opening force to standard values, wherein a flow velocity in accordance with the standard, for example of ≥6.56 ft/s, i.e. ≥2 m/s, is ensured between the stairwell and the utilization unit on the floor affected by the fire, and the stack effect does not have to be taken into account for normal operation and also in case of fire in the building.

Accordingly, it is an object of the present invention to overcome one or more of the above-described drawbacks and/or disadvantages of the prior art.

This object is achieved by a high-rise building with a stairwell, with an air supply shaft, with inlet openings connecting the air supply shaft to the stairwell, and with a pressure system for keeping the stairwell free from smoke, wherein the stairwell is vertically divided into several partial spaces by at least one partition, and each partition comprises a door which enables a passage suitable for persons from one partial space of the stairwell into the adjacent partial space. The stairwell forms a shaft like the elevator shaft.

According to the invention, the stairwell is divided in the vertical direction into partial spaces. Thus, sections are being formed. The individual partial spaces are respectively separated from one another by a partition. The division is not necessarily tight; however, it has only a low leakage rate. Low leakage rate means low in relation to the air supply; the leakage rate is, in particular, less than 5%, preferably 1% of the supplied air, or less than 0.33 ft/s, i.e., 0.1 m/s. Less than 35 ft$^3$, i.e., 1 m$^3$ per second is supposed to be lost by leaks.

As in the prior art, the air supply shaft remains continuous. The air supply shaft forms a shaft like the stairwell; however, the cross section is considerably smaller, at least 20 times smaller. The inlet openings remain. The changes over the prior art substantially are made to the stairwell. The type of control for the introduction of air into the air supply shaft and from the air supply shaft into the stairwell is also changed.

The stairwell is preferably divided outside of the stairs, for example parallel to individual staircases and, for example, on a landing or a turn. It can take place at a location where the entrance doors for the transition into the utilization unit are also disposed. However, it can also take place offset by half a story.

The air space of the shaft-like stairwell is divided by one partition, respectively, every 10 to 30 floors, in particular every 15 to 20 floors. In other words, sections of between 30 to 70 m are formed. The partition is both a pressure partition as well as a flow partition. If, for example, the high-rise building has 48 floors, it is expediently divided by two partitions into three partial spaces or pressure areas. A lower pressure area extends from the first floor (ground floor) to floor 16, the middle pressure zone covers the floors 17-32, and the upper pressure zone comprises the floors 32-48.

The division of the stairwell into individual partial spaces or pressure areas has the following advantages:

1. Upon detecting smoke from a fire, the fire alarm system activates the overpressure unit. The latter has a control unit controlling the supplied air flows; control takes place in such a manner that only the partial space in which the fire is located is supplied with air and thus overpressure.
   The number of the fans for supplied air thus remains substantially the same because only the air stream that is required in the respective pressure segment has to be supplied via the air supply shaft. A sufficient number of fans is kept ready in order for a secure pressure build-up to be secured in the partial space concerned. As in the prior art, the means are redundant.
2. In the case of fire, there is always the predetermined overpressure prescribed by the standard between the stairwell and the utilization unit in order to prevent smoke from entering the stairwell.
3. The stairwell is still available as a rescue path in those partial spaces outside of the area of the fire; there is no overpressure in those partial spaces. If floors located above the fire level have to be evacuated, those persons are able to pass through the pressurized area of the stairs. To this end, the doors in the partitions have to be opened in each case.

The partition preferably is a lightweight construction wall dividing the stairwell more or less tightly. Its purpose is to divide or separate the air space of the stairwell. As the partition is located in the fire section "stairwell," no fire regulation requirements are made with regard to the building materials, doors or regulating devices. Preferably, materials are used for the partition that are not combustible themselves or that have a sufficient fire rating.

The door of the partition is fitted in the escape direction, i.e., following the path from the top down. Preferably, an automatic door-closing unit is allocated to it. It is thus ensured that the door is normally closed. The door of the partition can also be configured as a swinging door with an appropriate bias in the closing direction.

Preferably, barometric flaps are provided in the partition wall which immediately ensure, in particular without any auxiliary power, a pressure equalization between the partial space affected by the fire and an adjacent partial space above or below. Barometric flaps can be configured as mechanical regulating units. Depending of the type of build, for example with weights or spring-loaded, they can be adapted to the required predetermined pressure. Preferably, two barometric flaps are inserted into a partition wall; they allow the air to flow into both directions. The barometric flaps are preferably disposed next to and above the door. They can also be formed in the door; they can be formed more or less by the door, e.g., a swinging door.

The design of the barometric flaps with regard to size and pressure difference is dependent on the fire protection concept. It is particularly relevant what the pressure difference is that is required between the stairwell and the utilization unit. The barometric flaps can be designed according to the prior art.

For example, if a fire starts on the 24th floor of a high-rise building, it is detected and air is supplied from the air supply shaft into the corresponding partial space of the stairwell, which is limited, for example, by the 16th and the 32nd floor. Preferably, corresponding valves, which are respectively disposed in a connection between the air supply shaft and the stairwell, are specifically opened for this purpose. Only those valves that are located in the partial space concerned are opened. In order to achieve a pressure difference of, for example, 1.04 lb/ft$^2$, i.e., 50 Pa, between the observed partial space of the stairwell and the utilization unit, or to generate an air stream of ≥6.56 ft/s, i.e., ≥2 m/s, into the floor affected by the fire, an air volume of about $670\times10^3$ ft$^3$/hour, i.e., 20,000 m$^3$/h, is required. In order to have a sufficient safety margin, for example, with regard to unplanned leakage, about $1\times10^6$ ft$^3$/hour, i.e., 30,000 m$^3$/hour, are supplied to the observed partial space of the stairwell in practice.

If the pressure exceeds the maximum of 1.04 lb/ft$^2$, i.e., 50 Pa, due to the doors closing, the barometric flaps act as pressure relief flaps, and do so in two directions: the barometric flap opening in the upward direction in the upper partition of the partial space causes an outward flow upwards into the non-pressurized partial space located above it. The barometric flap opening in the upward direction in the lower partition of the partial space causes an outward flow upwards into the non-pressurized partial space located below it. It is thus ensured at all times that the maximum pressure difference in the partial space is maintained over its entire height.

The advantage of the partition is not only evident in the case of fire but already in normal operating conditions. In this case, static air pressure is provided in the stairwell. As a rule, there is no additional supply of air into the stairwell.

A stack effect occurs in very high buildings with continuous stairwells that always have defined or unknown leaks. The stack effect is caused by the differences in temperature between the inside and the outside. The pressure differences that occur can be rather considerable, see the above table, so that the forces acting on the doors prevent the doors from being capable of being opened by everybody at any time. The partitions interrupt the stack effect so that critical threshold values are not reached. Empirically, no effective stack effect occurs above the height of a section, that is, above 197 ft, i.e., 60 meters, in the vertical direction. Therefore, the stack effect is also neutralized by the invention. This is independent from the state of the fire. The stack effect is interrupted in the normal state.

In the case of fire, air is blown in the known manner into the air supply shaft by means of fans. This can take place at any location. It can take place, for example, on floor 0 (ground floor), it can take place on the uppermost floor, but it can also take place at an intermediate location, for example, on a service floor.

The air pressure decreases as the height increases; this can be calculated by means of the barometric equation. Therefore, the air on the uppermost story of the building is thinner than on floor 0 (ground floor). At the same rotational speed, a fan will deliver a smaller air volume in thinner air. The barometric effect can be corrected by computers. As the height of the story affected by the fire is known, the fans can be operated at the appropriate rotational speed in order to compensate the decrease in volume in accordance with the barometric equation.

Other advantages and features of the invention become apparent from the other claims as well as from the following description of an exemplary embodiment of the invention, which shall be understood not to be limiting and which will be explained below with reference to the drawings.

DETAILED DESCRIPTION OF EMBODIMENTS OF THE INVENTION

Figure 1:
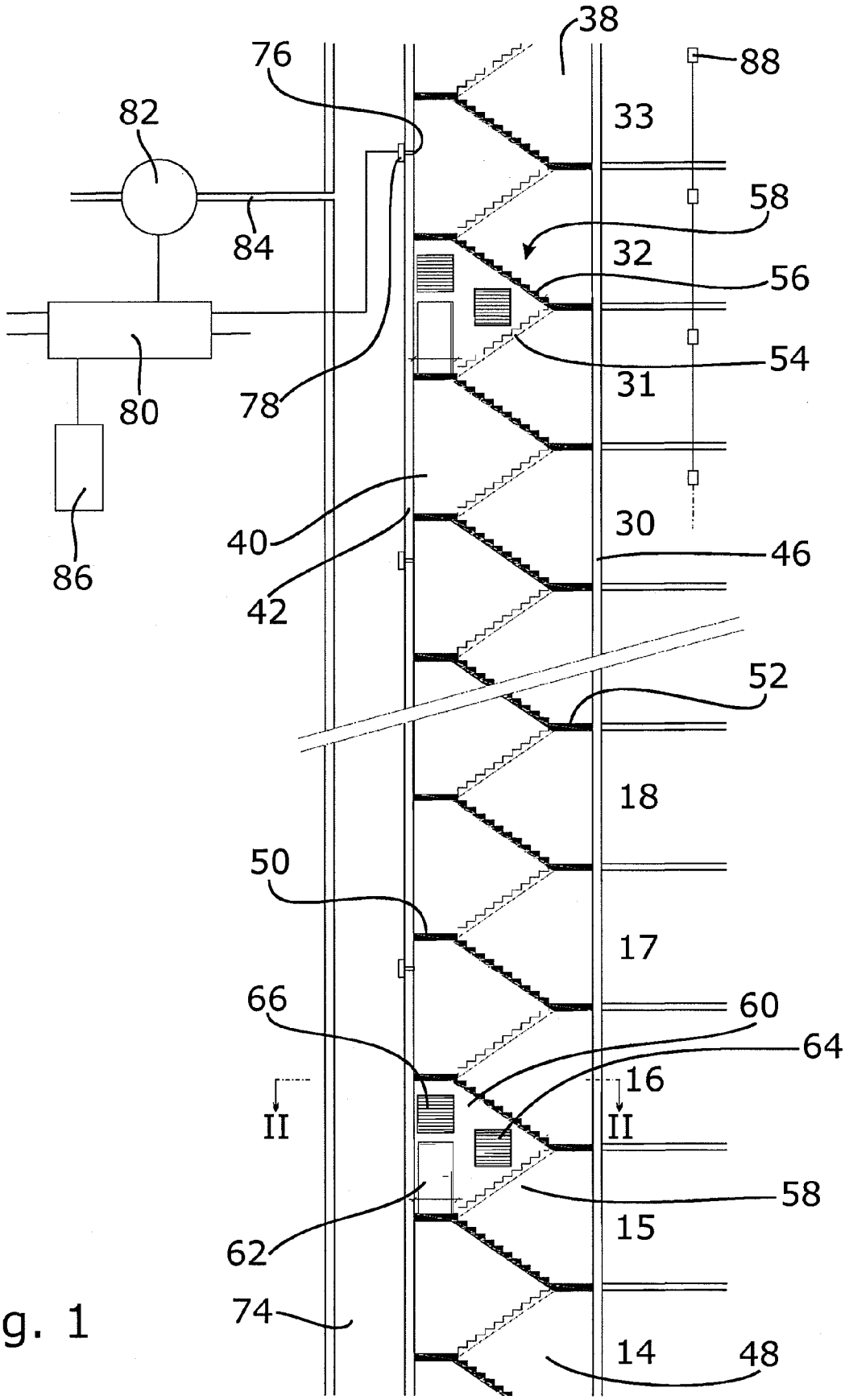
FIG. 1 is a sectional view through a part of a stairwell of a high-rise building taken along line I-I of FIG. 2.
Figure 2:
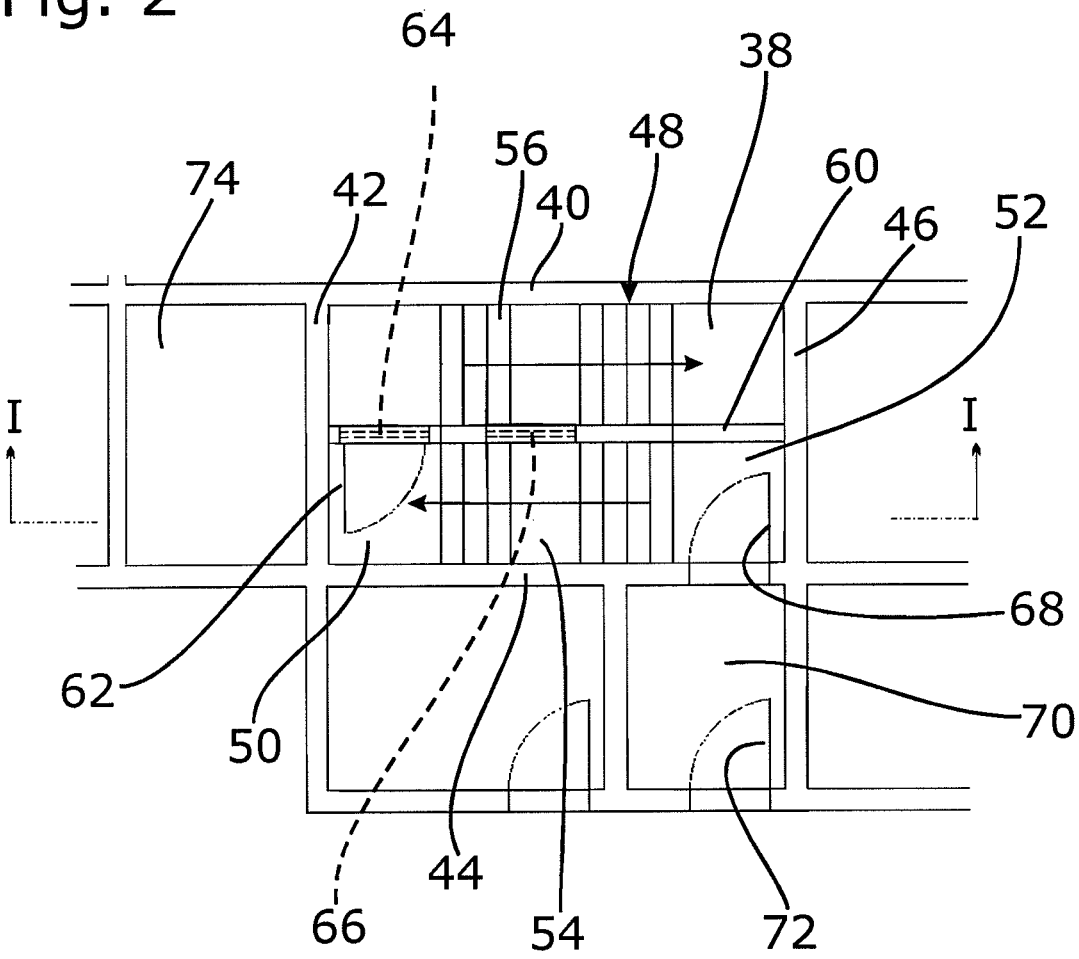
FIG. 2 is a part of a floor plan of a high-rise building for a floor in which a partition is located, taken along line II-II of FIG. 1 and at about twice the scale of FIG. 1.

Of a high-rise building, FIG. 1 shows a stairwell 38 having a vertical shaft. The stairwell 38 extends over the floors 14-33 (with a gap drawn in between 19 and 29). The shaft of the stairwell 38 is limited by walls 40, 42, 44 and 46. The stairwell 38 comprises a staircase 48. The staircase 48 consists of individual floor staircases that are respectively configured, in the example shown, as a U-staircase with a half-landing 50. Each floor staircase includes a landing 52 to which a lower flight of stairs 54 leading into the half-landing 50 adjoins. An upper flight of stairs 56 extends therefrom to the next landing above it of the next floor staircase. A well hole that is normally open is located between the two flights of stairs 54, 56. In the embodiment shown, however, it is closed in the area between the stories 15 and 16 as well as between the stories 31 and 32.

This is done in each case by means of a partition 58. This partition 58 comprises a partition wall 60. With regard to its shape, it is composed of an elongate rectangle and a triangle attached to a long side of this rectangle. The partition wall 60 is vertically oriented. The sides of the triangle that are not connected to the rectangle reach into the well holes of the lower flight of stairs 54 and of the associated upper flight of stairs 56. The rectangle described connects the half-landings 50 of floors that are located one above the other. On the whole, a more or less tight division is accomplished. Two such partitions 58 are shown in FIG. 1, one between the 16th and 17th story, the other between the 31st and 32nd story.

A door 62 is built into the partition wall 60. Expediently, an overhead door closer (not shown) is allocated to it. Furthermore, two barometric pressure flaps 64 and 66 are built into the partition wall 60. They work in different directions. The pressure flap 64 opens from the bottom upwards, the pressure flap 66 works in the opposite direction. The two are preferably identical in construction. They are configured in accordance with the prior art and set to open automatically at a given pressure value, for example 1.04 $lb/ft^2$, i.e., 50 Pa. It is possible to realize both passing directions in a single pressure flap.

From the landing 52, a lock 70 is reached through a stairwell door 68 in the known manner, and the associated story is reached from there through an entrance door 72. In the exemplary embodiment shown, the stairwell door 68 and the door 62 of the partition 58 are offset by half a story. This is not a requirement, and other configurations are also possible.

In the known manner, the high-rise building has an air supply shaft 74. Just like the stairwell 38 it extends over the entire height of the building concerned, at least the section concerned. In certain intervals, for example every three to eight stories, the air supply shaft 74 is connected with the stairwell 38, in particular on service floors, via inlet openings or ducts 76. A controllable valve 78 is allocated to every duct 76. Normally, it is closed. Every single valve 78 is connected to a control unit 80.

The air supply shaft 74 is supplied with air in the known manner. This is usually done through several fans that can be disposed at different places. By way of example, a fan 82, which, if required, supplies air to the air supply shaft 74 via a pipe 84, is drawn in FIG. 1. The fan 82 is controlled by the control unit 80.

Furthermore, a fire alarm system 86 is provided. It detects a case of fire and issues a fire alarm to the control unit 80. To this purpose, it is electrically connected with the latter. The fire alarm system 86 comprises several fire detectors 88 that are provided for each story and of which only some are shown by way of example. They are connected to one another and to the fire alarm system 86 through a bus, for example. If one of these fire detectors 88 is activated, the fire alarm system 86 is provided with information of there being a case of fire and on the affected story. They are forwarded to the control unit 80. This now determines which partial space is affected, starts the fans to the required extent and, optionally, taking into account the height, and opens those valves 78, or optionally only a part thereof, that lead into the partial space affected. The prescribed overpressure is thus reached in the partial space.

Air arrives in the stairwell 38 exclusively via the air feed through the ducts 76 and through the air supply shaft 74. There are no other air supply sources for the stairwell 38.

Figure 3:
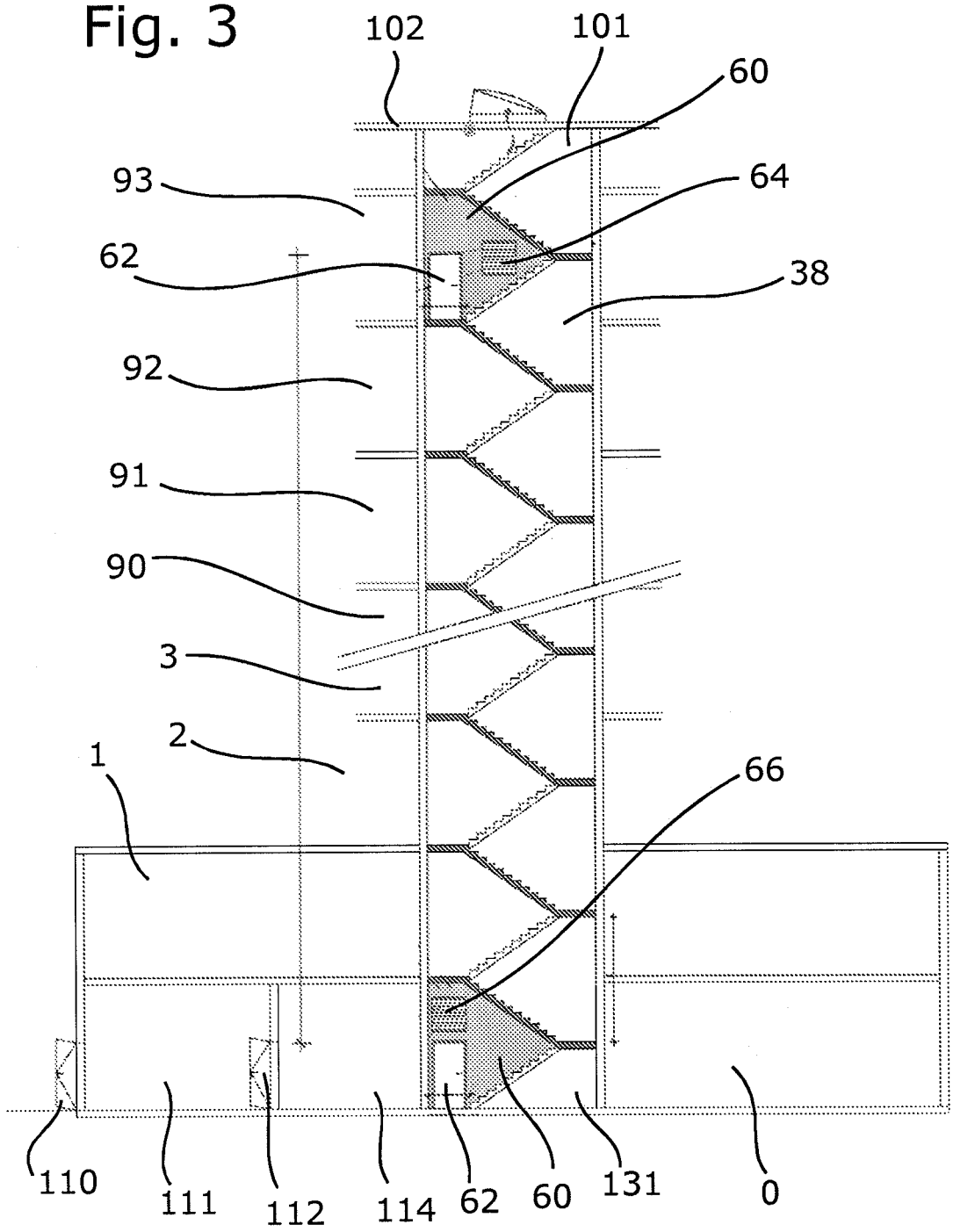
FIG. 3 is another is a sectional view through a part of a stairwell of a high-rise building taken along line I-I of FIG. 2.

The configuration of the lowermost partial space and the uppermost partial space will be explained with reference to FIG. 3. The floors 0 (ground floor), 1 and 2 are shown for the lower partial space and the floors 90 to 93 for the uppermost partial space. Details as they are apparent from FIG. 1 and add up to the configuration of the air supply shaft, the ducts, valves and the air feed into the air supply shaft 74 are not shown in FIG. 3 in order to simplify the drawing. They are, however, provided.

A partition 58 is located above the last floor that can be used normally, in this case story 93. In the known manner, this partition 58 comprises a partition wall, as it is described in FIG. 1, with a door 62 provided therein. Such a door can be omitted if it is possible to reach the space above story 93 not via the stairwell, but, for example, through other entrances. A barometric pressure flap 64 that opens from the bottom upwards is also built into the partition wall 60. Expressly, a pressure flap in the opposite direction is not provided. This means that air can only escape upwards through the uppermost partition, but that no air can flow in from above, that is, above story 93.

A room 101 is located above the uppermost partition 58. It approximately has the height of a story. A roof 102 is located above this room. A ventilation flap 103 is disposed in the roof 102. It corresponds to the prior art. Only an outward flow in an upward direction is possible through it.

An entrance door 110 is provided on the floor 0 (ground floor); an exit area 111 can be reached through it. The latter is closed towards the side of the building by means of an inner access door 112. One has to pass through both doors 110, 112 in order to reach the stairwell 38. An entrance area 114 is located behind the access door 112. From there, a lower room 131 of the stairwell 38 is reached through a door 62. The door is disposed in a partition 58 that separates the entrance area 114 from the lower room 131. A pressure flap 66 that permits an outward flow only from the top downwards is disposed in the associated partition wall 60. It is also possible to dispose the partition wall that was just described between the first and second story or between the second and third story.

As should be recognized by those of ordinary skill in the pertinent art based on the teachings herein, numerous changes and modifications may be made to the above-described and other embodiments of the present invention without departing from its scope as defined in the appended claims. Accordingly, this detailed description of embodiments is to be taken in an illustrative, as opposed to a limiting, sense.

What is claimed is:

1. A high-rise building, comprising:

a plurality of stories having a height of the building;

a stairwell;

an air supply shaft extending over the entire height of the building;

inlet openings connecting the air supply shaft to the stairwell; and a pressure system for keeping the stairwell free from smoke, wherein the stairwell is vertically divided into partial spaces by at least one partition, each partial space extends over multiple of said stories, each partition comprises at least one pressure flap and a door, and the door enables a passage from one partial space of the stairwell into an adjacent partial space, at least one of (i) each partial space has a number of said inlet openings that is less than the number of said multiple stories over which said partial space extends, (ii) at least two adjacent stories of the same partial space are connectable to the air supply shaft by only one of said inlet openings, and (iii) at least one story of each partial space does not include an inlet opening, and at least one inlet opening within each partial space provides air to those of said stories within that partial space that does not include an inlet opening, wherein the air supply shaft is connected to each of the partial spaces via at least one of the inlet openings that have a valve allocated thereto, wherein the building comprises a fire alarm system and a control unit, the control unit is operatively connected to the fire alarm system, and in case of a source of fire located in one of the stories, the control unit controls air flows through the inlet openings and supplies with air only said partial space of the stairwell that corresponds to the location of the source of the fire, and wherein the valve controls said flow of air passing through the inlet openings and is operatively connected to the control unit therefore, and wherein information is stored in the control unit as to which of the stories of the building are associated with which of the partial spaces of the stairwell.

2. A high-rise building according to claim 1, wherein the partial spaces extend over ten to thirty stories.

3. A high-rise building according to claim 1, wherein the at least one pressure flap is a barometric pressure flap.

4. A high-rise building according to claim 1, wherein the partition comprises two pressure flaps disposed in different flow directions.

5. A high-rise building according to claim 1, wherein the door opens in an escape direction.

6. A high-rise building according to claim 1, wherein the door is normally in an opened position, and, only in case of a fire alarm, the door is moved into one of a partially closed position and a closed position.

7. A high-rise building according to claim 1, wherein the partition is normally incomplete, and mechanically completed in response to a fire alarm.

8. A high-rise building according to claim 1, further including a fire alarm system, wherein the fire alarm system comprises a plurality of fire detectors and is configured such that a story of the building in which a case of fire occurs can be determined.

9. A high-rise building according to claim 1, wherein the door is one of a hinged door and a swinging door.

10. A high-rise building according to claim 1, wherein the partial spaces extend over fifteen to twenty stories.

11. A high-rise building according to claim 1, wherein the partition normally does not completely separate adjacent partial spaces, and in case of a fire alarm, the partition is configured to completely separate said adjacent partial spaces.

12. The high-rise building according to claim 1, wherein the partition comprises two pressure flaps that allow air to flow in different directions.

* * * * *